United States Patent [19]

Bridgeman

[11] Patent Number: 4,500,307

[45] Date of Patent: Feb. 19, 1985

[54] APPARATUS FOR PRODUCING CONTINUOUS BAGS OF THIN WALL MATERIAL

[76] Inventor: Danial N. P. Bridgeman, 12650 Skyline Blvd., Woodside, Calif. 94062

[21] Appl. No.: 314,205

[22] Filed: Oct. 23, 1981

[51] Int. Cl.[3] ..... B31B 1/64

[52] U.S. Cl. ..... 493/196; 493/198; 493/230; 493/365

[58] Field of Search ..... 493/193–201, 493/238, 227, 364, 365, 363, 230, 233; 53/385

[56] References Cited

U.S. PATENT DOCUMENTS

| | | | |
|---|---|---|---|
| 3,286,005 | 11/1966 | Cook | 493/187 X |
| 3,552,278 | 1/1971 | Guenther | 493/196 |
| 3,994,209 | 11/1976 | Jacob | 493/188 X |
| 4,041,846 | 8/1977 | Lerner | 493/198 X |
| 4,334,399 | 6/1982 | Onishi | 53/385 X |

*Primary Examiner*—James F. Coan

*Attorney, Agent, or Firm*—Limbach, Limbach & Sutton

[57] ABSTRACT

An apparatus and method for production of continuous bags of thin material with each of the bags having an opening on the side is disclosed.

6 Claims, 6 Drawing Figures

APPARATUS FOR PRODUCING CONTINUOUS BAGS OF THIN WALL MATERIAL

BACKGROUND OF THE INVENTION

The present invention relates to a method and apparatus for producing bags and, more particularly for producing continuous bags of thin material wherein each of the bags has an opening on a side.

Method and apparatus for the production of continuous bags of thin material, such as polyethylene is well known. One well known example of such bags is a common-day plastic bag which is used in grocery stores or supermarkets. These bags are characterized by being in a continuous roll on a reel with perforations through the bag separating one bag from the other. To use each bag, the shopper grasps a bag, tugs the bag, tearing it from the reel along the line of perforation. The bag then has an opening along the line of perforation. The line of perforation serves as the connection between one bag and another while on the reel, at the same time, once each bag is torn along the line of perforation, the line of perforation (line of tear) becomes the opening to the bag.

In certain applications, however, it is desirable to manufacture such continuous bags, with each bag connected to the adjacent bag and with each bag having an opening along one side of the perforation, or a line of tear along one side of the bag. Such continuous bags are used in other manufacturing processes in which items are inserted into each bag through the opening in a continuous fashion. Thus, in such application, it is desired to manufacture continuous bags of thin material with each of the bags having an opening on a side.

Heretofore, continuous bags of thin material have been manufactured by a reel means for supplying a continuous length of advancing thin tubing. The tubing is passed through a perforating blade, perforating said tubing in a plurality of first spaced locations. Sealing means then seal the tubing in a plurality of second spaced locations, thereby forming the continuous bags.

In a co-pending U.S. patent application Ser. No. 230,303 filed by me, I disclosed a method and an apparatus for producing continuous bags of thin material with each of the bags having an opening on a side. In that co-pending patent application, after the continuous bags of thin material separated by a line of perforation is produced, a drag means and a roller means cooperate to cause separation on one side of the bag along the line of perforation. The drag means is located to one side of the bags while the roller means is located to the other side of the continuous bags. The drag and roller means frictionally engage one another to cause the line of perforation on one side of the bags to tear to become a line of separation or an opening to the bags.

In U.S. Pat. No. 2,973,697, a method and an apparatus for producing continuous bags that are notched on one side is taught. The notching of the bags does not result in the production of continuous bags of thin material that are connected along a line of perforation with each of the bags having an opening on the side along the line of perforation.

SUMMARY OF THE INVENTION

The present invention is an improved apparatus for the production of continuous bags of thin material with each of the bags having an opening on the side. The apparatus has reel means for supplying a continuous length of advancing thin tubing advancing in the direction of production. The tubing has a width substantially perpendicular to the tubing and sealing means adapted for sealing the tubing in a plurality of first spaced locations. The improvement to the foregoing apparatus has means for perforating substantially one-half of the width of the tubing in a plurality of second spaced locations and means for cutting substantially the other half of the width of the tubing in said plurality of second spaced locations. In another embodiment of the present invention, the improvement to the apparatus comprises means for cutting one side of the tubing in a plurality of second spaced locations, and means for simultaneously perforating the other side of the tubing in said plurality of second spaced locations.

The present invention also relates to a method of using the foregoing described improved apparatus.

DETAILED DESCRIPTION OF THE DRAWINGS

Figure 1:
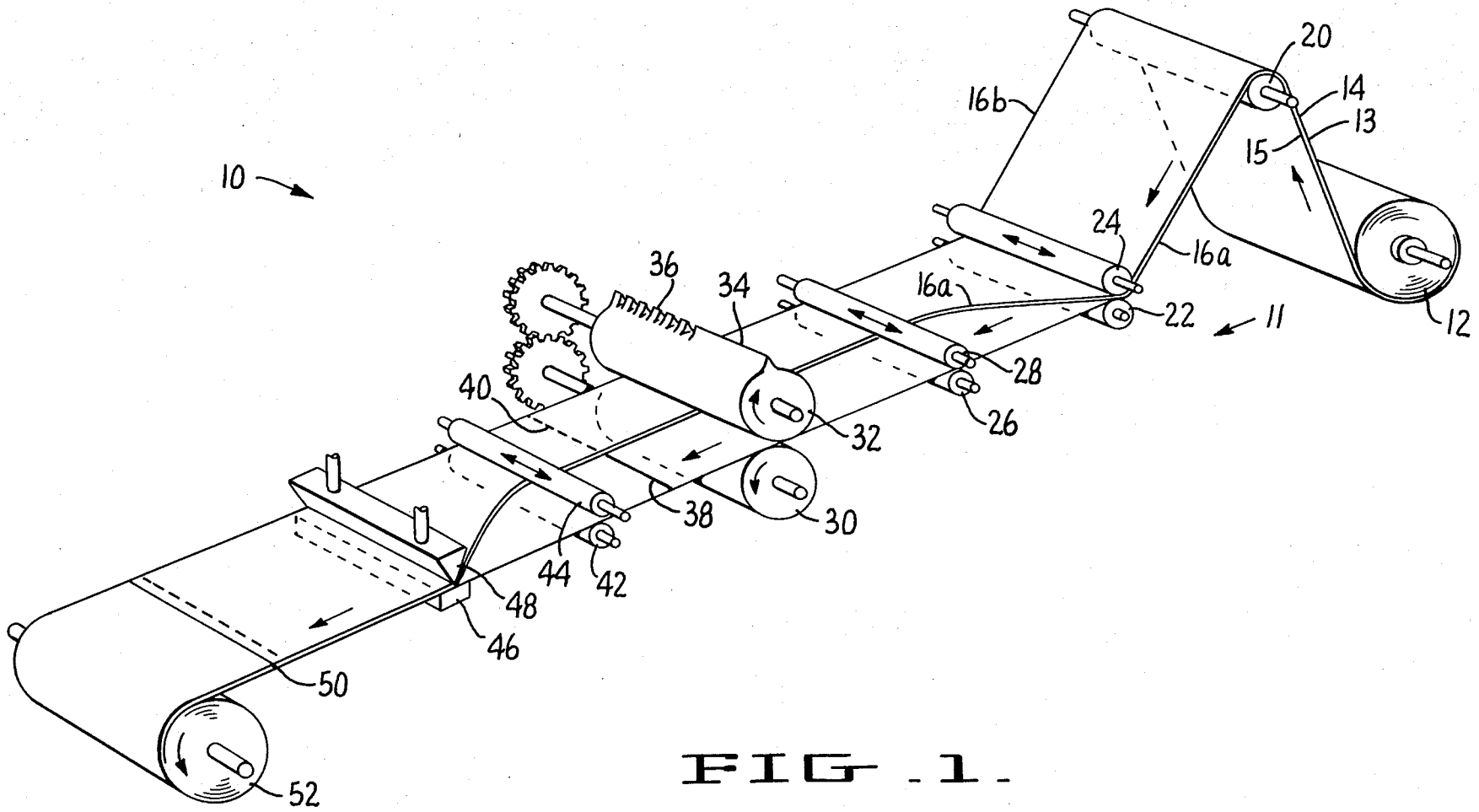
FIG. 1 is a perspective view of an apparatus incorporating one embodiment of the improvement of the present invention.

Referring to FIG. 1, there is shown an apparatus 10 incorporating the improvement of the present invention. The apparatus 10 comprises a reel 12 for supplying a continuous length of advancing thin tubing 14. The thin tubing is typically of polyethylene material. However, other materials may also be suitably used. The tubing 14 is characterized by a first edge 16A and a second 16B. The tubing 14 is formed of two opposed walls, 13 and 15 respectively, that are sealed at the edges 16A and 16B respectively. The tubing 14 is passed along the direction shown by the arrow 11 in the production process in the apparatus 10. The tubing 14 passes a number of rollers, one of which is designated 20. The rollers, e.g. roller 20, helps to smooth out the tubing 14 to make a continuous plurality of bags from the tubing 14. The tubing is passed through a first set of rollers 22 and 24 that twist the tubing 14 substantially ninety (90) degrees. The rollers 22 and 24 move in a direction which is substantially perpendicular to the direction of the production process, as shown by arrow 11. The function of these first rollers, 22 and 24, serves to twist the tubing 14 substantially ninety (90) degrees which moves the edges 16A and 16B into the center of the advancing tubing. The tubing 14 is passed over a second set of rollers, 26 and 28 respectively, which also serve as part of the roller process to rotate or twist the tubing 14 substantially 90 degrees. The second set of rollers, 26 and 28, move in the same direction as the first set of rollers, 22 and 24, i.e., substantially perpendicular to the direction shown by the arrow 11. Once the tubing 14 has been twisted 90 degrees, it is passed through a perforating/cutting stage comprising a perforation/cutting roller 32 to one side of the tubing 14 and a backing roller 30 to the other side of tubing 14. The perforation/cutting roller 32 has a length at least the width of the tubing 14, as measured in a direction substantially perpendicular to the direction of the arrow 11. One half of the perforation/cutting roller 32 is a perforation stage, comprising of a plurality of teeth 36 notched on the roller 32 such that as the roller 32 rotates, the teeth 36 come into contact with the tubing 14 and puncture through the tubing 14 against the backing roller 30, creating a line of perforation 40. The line of perforation 40 is substantially one-half of the width of the tubing 14. The other half of the length of the perforation/cutting roller 32 is a cutting blade 34. As the perforation/cutting roller 32 rotates and as the teeth 36 puncture through the tubing 14 forming a line of perforation 40, simultaneously the cutting blade 34 cuts through the tubing 14 to form a line of cutting 38. The line of perforation 40 is colinear with the line of cutting 38 and is substantially perpendicular to the direction of production, as shown by the arrow 11. The line of cutting 38 is to the other half of the width of the tubing 14. The perforation/cutting roller 32 is aligned substantially perpendicular to the direction of production, and as the roller 32 rotates, once in every revolution the teeth 36 and the cutting blade 34 would engage the tubing 14 and puncturing and cutting therethrough. Thus, as the perforation/cutting roller 32 rotates against the backing roller 30, a plurality of lines of perforation 40/lines of cutting 38 in the tubing 14 are created in a first spaced location. The perforation portion of the perforation/-cutting roller 32 is adapted to perforate the tubing 14 in a plurality of perforations substantially on one half of the tubing 14. Because the tubing 14 has been twisted substantially 90 degrees, this results in a line of perforation 40 through one wall 13 of the tubing 14 while the line of cutting 38 is through the opposed wall 15 of the tubing 14. Thus, a line of perforation through one wall 13 of the tubing 14 is created while simultaneously a line of cutting 38 is created in the opposed wall 15 of the tubing 14. Next, as the tubing 14 travels down the apparatus 10, the tubing 14 is retwisted 90 degress by the third set of rollers 42 and 44 respectively. These third set of rollers function substantially in the same manner as the first and second set of rollers in twisting the tubing 14 substantially 90 degrees so that the tubing 14 would have the edges 16A and 16B respectively on the edges of the direction of production. The tubing 14 is then sealed by a sealer 48. The sealer 48 seals tubing 14 in a plurality of second spaced locations 50, each of which is substantially parallel to the first spaced locations 40. The bags, with a opening in one side (as shown by a line of cutting 38 in the opposed wall 15 of the tubing 14) are then wound around a windup reel 52.

Figure 2:
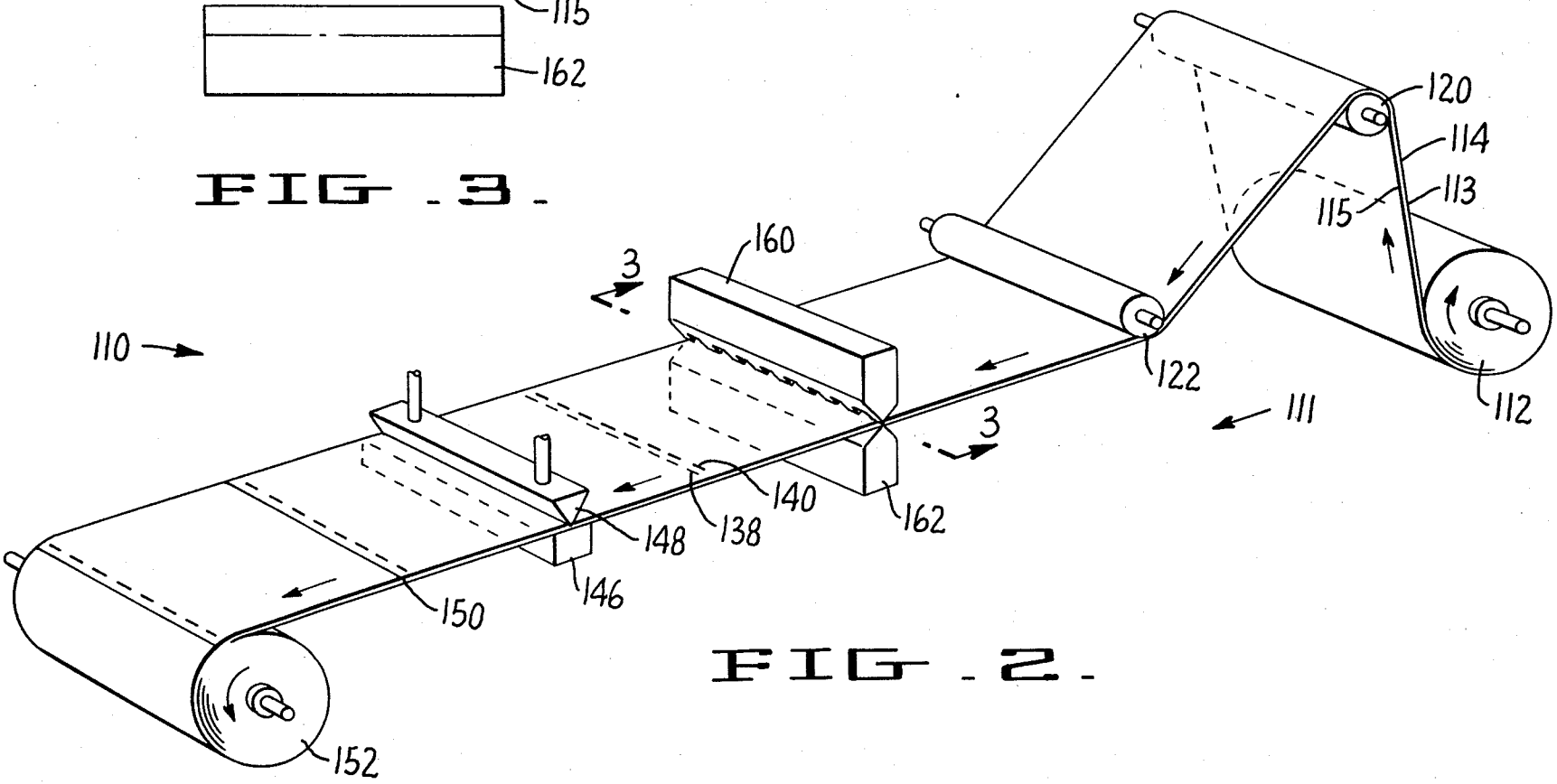
FIG. 2 is a perspective view of an apparatus incorporating another embodiment of the improvement of the present invention.
Figure 3:
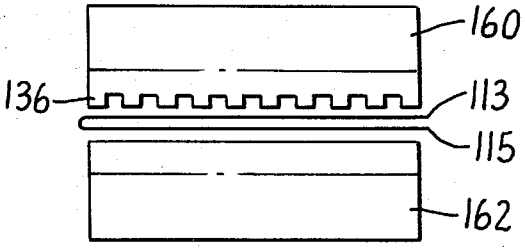
FIG. 3 is a cross sectional view of a portion of the apparatus of FIG. 2 taken along the line 3—3.

Referring to FIG. 2 there is shown another improved apparatus 110 of the present invention. The improved apparatus 110 comprises a reel 112 for supplying a continuous length advancing thin tubing 114. The thin tubing 114 has two opposed walls, 113 and 115 respectively. The thin tubing 14 is passed along the direction shown by the arrow 111 in the production process of the apparatus 110. The tubing 114 passes a number of rollers designated by 120 and 122 respectively. Thus far, the apparatus is similar to the apparatus described heretofore. The tubing 114 then passes through a perforation/cutting stage comprising a first perforation blade 160 to one side of the tubing 114. A first cutting blade 162 is to the other side of the tubing 114. The first perforation blade 160 has a plurality of teeth 136 notched in the blade. The first perforation blade 160 is adapted to move in a direction substantially perpendicular to the direction of production 111. As the tubing 114 passes between the first perforation blade 160 and the first cutting blade 162, the first perforation blade moves to come into contact with the tubing 114. The teeth 136 of the first perforation 160 press against the one wall 113 of the tubing 114 and against the blade 162. Simultaneously, the first blade 162 is brought into contact with the tubing 114 and presses against the opposed wall 115 of the tubing 114 and against the first perforation blade 160 on the other side. In short, the first perforation blade 160 and the first cutting blade 162 serve as the anvil backing to one another as each is brought into contact with one another, with the tubing 114 therebetween. This action may be seen in FIG. 3. As the first perforation blade 160 and the first cutting blade 162 are brought closer, eventually a line of perforation 140 is made on one wall 113 of the tubing 114 by the plurality of teeth 136 of the first perforation blade 160, and simultaneously a line of cutting 138 is made in the opposed wall 115 of the tubing 114 by the cutting blade 162. Since it is desirable to perforate only the one wall 113 and cut only the opposed wall 115, the degree of perforation/cutting is controlled by the amount of pressure between the perforating blade 160 and the cutting blade 162. The movement of the first perforation blade 160 and the first cutting blade 162 to and from one another is repeated thereby creating a plurality of spaced apart locations of lines of perforation 140 with lines of cutting 138 directly opposite and on the opposite wall. Next, the tubing 114 is sealed by a sealer 148, which as previously described seals the tubing 114 in a plurality of second spaced locations 150, each of which is substantially parallel to each of the first spaced location 140, 138. The continuous bags are then wound up at a wind up reel 152.

Figure 4:
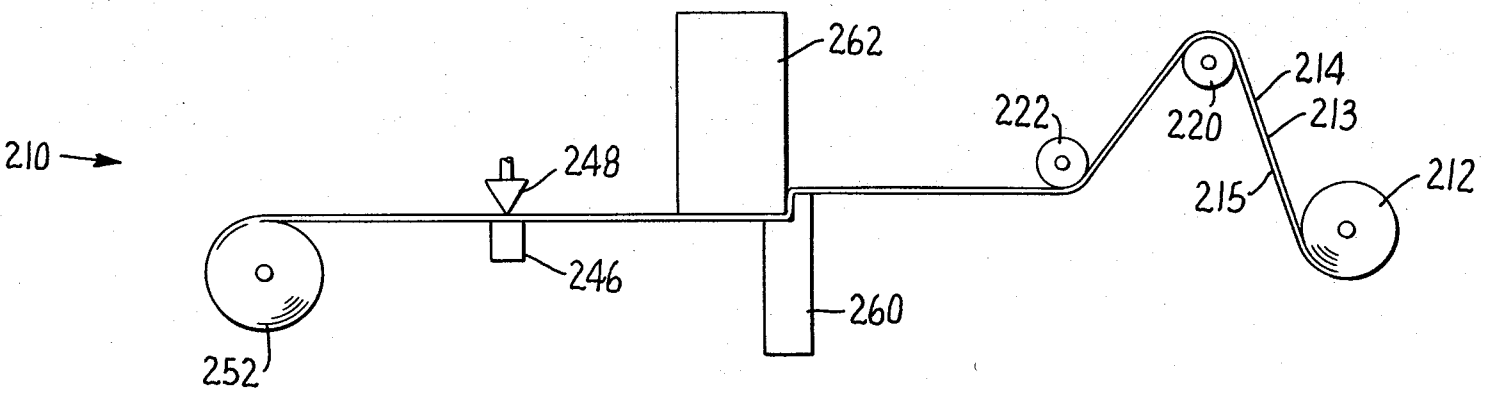
FIG. 4 is a side view of an apparatus incorporating yet another embodiment of the improvement of the present invention.
Figure 6:
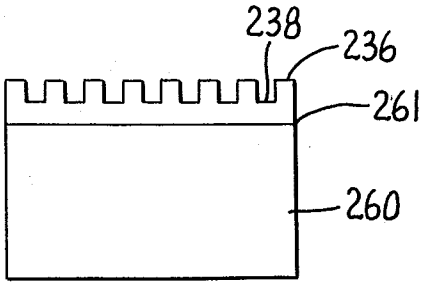
FIG. 6 is a side view of the portion of the apparatus shown in FIG. 5.
Figure 5:
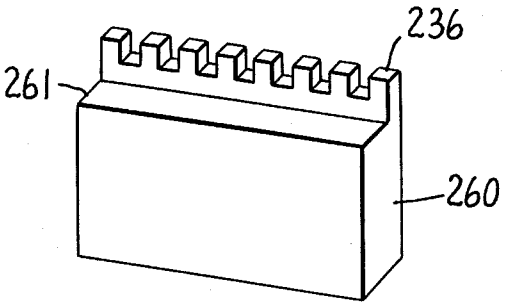
FIG. 5 is a perspective view of a portion of the apparatus of FIG. 4.

Referring to FIG. 4, there is shown yet another embodiment of the improvement of the present invention shown as apparatus 210. The apparatus 210 comprises, as described before, a reel 212 for the supply of a continuous length of advancing thin tubing 214 which has two opposed walls, 213 and 215 respectively. The advancing thin tubing 214 is passed over a plurality of rollers 220 and 222. The advancing tubing 214 is then passed over a perforation/cutting blade 260 to one side of the tubing 214. On the other side of the tubing 214 is an anvil 262. The perforation/cutting blade 260 on one side of the tubing 214 comprises a plurality of spaced apart teeth 236. Each of the plurality of teeth 236 has a height associated therewith, rising above the anvil stops 261. The height of the teeth 236 is such that the perforation/-cutting blade 260 is adapted to cut through the opposed wall 215 and through the one wall 213 before the anvil stop 261 comes to rest against the anvil 262 thereby limiting the movement of the perforation/cutting blade 260 in a direction substantially perpendicular to the direction of production. Between each adjacent teeth 236 is a cutting blade 238. Each of the cutting blade 238 is spaced at a depth of separation from its adjacent perforation blade 236 or the teeth 236. The difference in height between the perforation blade 236 from the anvil stop 261 and the heigh of its adjacent cutting blade 238 from the anvil stop 261 is substantially the thickness of the first wall 213 and the second wall 215 of the tubing 214. When the perforation/cutting blade 260 is moved in a direction substantially perpendicular to the direction of production of the tubing to the anvil 262, the plurality of teeth 236 first puncture through the opposed wall 215. As the perforation/cutting blade 260 moves further to the anvil 262 with the tubing 214 therebetween, the perforation blade 236 will perforate the one wall 213 of the tubing 14. Simultaneously, the cutting blade 238 of the perforation/cutting blade 260 would then cut the opposed wall 215, forming a line of cutting on the opposed wall 215 of the tubing 214. At this point, movement of the perforation/cutting blade 260 is limited by the anvil stop 261 in that the anvil stop 261 would have come to rest against the anvil 262. The movement of the perforation/cutting blade 260 forms a plurality of lines of perforation/cutting in a plurality of first spaced locations. The sealer 248 seals the tubing 214 in a plurality of second spaced locations. The bags are then wound at the wind up reel 252.

What is claimed is:

1. An apparatus for the production of continuous bags of thin material with each of said bags having an opening on a side, wherein said apparatus having reel means for supplying a continuous length of advancing thin tubing advancing in the direction of production, said tubing having a width substantially perpendicular to said direction of production, sealing means for sealing said tubing in a plurality of first spaced locations, wherein said improvement comprising:

a single blade having a length at least the width of said tubing; said blade adapted to cut through substantially one half the width of said tubing, and to perforate through the other half of the width of said tubing.

2. The apparatus of claim 1 further comprising first means for twisting said tubing substantially ninety degrees prior to perforation; and second means for twisting said tubing substantially ninety degrees after said cutting.

3. An apparatus for the production of continuous bags of thin material with each of said bags having an opening on a side, wherein said apparatus comprises:

reel means for supplying a continuous length of advancing thin tubing;

sealing means for sealing said tubing in a plurality of first spaced locations;

anvil means to one side of said tubing;

a single blade means having a plurality of spaced apart teeth and a plurality of cutting blades between each adjacent teeth; and said blade means positioned on other side of said tubing and adapted to move to said anvil means, with said tubing therebetween.

4. The apparatus of claim 3 wherein said blade means further comprising anvil stop means to limit the movement of said blade means to said anvil means.

5. The apparatus of claim 4 wherein each of said teeth and each of said cutting blades protrudes from said blade means and each of said teeth having a height of protuberance from said blade means greater than that of its adjacent cutting blade.

6. The apparatus of claim 5 wherein the difference in the heights of protuberance of a tooth and its adjacent cutting blade is substantially the thickness of the walls of said tubing.

* * * * *